United States Patent [19]

Lin

[11] Patent Number: 4,705,493

[45] Date of Patent: Nov. 10, 1987

[54] TRANSMISSION MECHANISM FOR GYMNASTIC BICYCLE

[75] Inventor: Jui-Chin Lin, Kuan Shyh, Taiwan

[73] Assignee: Shinn Fu Corporation, Taiwan

[21] Appl. No.: 904,391

[22] Filed: Sep. 8, 1986

[51] Int. Cl.[4] ..... F16H 9/04

[52] U.S. Cl. ..... 474/69; 474/88; 272/73

[58] Field of Search ..... 474/66–70, 474/73, 84–89; 272/73

[56] References Cited

U.S. PATENT DOCUMENTS

| | | | |
|---|---|---|---|
| 2,753,722 | 7/1956 | DeGrave | 474/88 X |
| 2,828,845 | 4/1958 | Thornton | 474/73 X |
| 3,129,601 | 4/1964 | Edwards | 474/88 X |
| 3,979,964 | 9/1976 | McCordall | 474/69 |
| 4,188,030 | 2/1980 | Hooper | 272/73 |
| 4,358,105 | 11/1982 | Sweeney, Jr. | 272/73 |

*Primary Examiner*—Stephen J. Novosad
*Assistant Examiner*—Thuy M. Bui
*Attorney, Agent, or Firm*—Wenderoth, Lind & Ponack

[57] ABSTRACT

An improved transmission mechanism for a gymnastic bicycle, in which the loaded fly wheel is mounted on the same shaft of the driving wheel, being in parallel with the same. The mechanism also comprises a set of transmission wheels so as to have the rotation speed ratio between the driving wheel and the loaded fly wheel reached 1:9. This transmission mechanism not only can obtain a high speed exercise result, but also can reduce the dimensions of the loaded fly wheel, and can improve the form of the bicycle, reduce the length of the transmission mechanism, and reduce the whole length of the gymnastic bicycle as well.

1 Claim, 4 Drawing Figures

TRANSMISSION MECHANISM FOR GYMNASTIC BICYCLE

FIELD AND BACKGROUND OF THE INVENTION

This invention relates to an improved transmission mechanism for a gymnastic or exercise bicycle, in which the loaded fly wheel is mounted in parallel with the driving wheel on the same shaft. The transmission mechanism has one set of transmission wheels, whereby the rotation speed ratio between the driving wheel and the loaded fly wheel would reach 1:9. This transmission mechanism not only can increase the results of exercise, but also can reduce the dimensions of the loaded fly wheel, and therefore, the length of the transmission mechanism, and the length of the whole gymnastic bicycle as will.

At the present time, the gymnastic bicycle is a rather popular indoor exercise equipment. A user can drive the two pedals to rotate the loaded fly wheel, as if riding on a bicycle for gymnastic purpose. That kind of bicycle is usually to be operated at a stationary spot for fulfilling the gymnastic purpose. The conventional fly wheel of the gymnastic bicycle is usually furnished with a balance weight means. The diameters among the driving wheel, the loaded fly wheel, and the transmission wheel are different so as to require the user to pedal the bicycle with more physical force for obtaining exercise. As such bicycles are mainly used for indoor exercise, they are required to have the minimum dimensions with a maximum exercising efficiency; therefore, the driving wheel and the loaded fly wheel of conventional exercise bicycles have a rotation speed ratio of 1:3.

In the present invention, the transmission mechanism of the gymnastic bicycle has made a breakthrough in the rotation speed ratio of the conventional transmission mechanism in the gymnastic bicycle, and has had the rotation speed ratio raised up to 1:9, which reduces the length and dimensions of the bicycle so as to facilitate the installation, or handling or manufacturing thereof.

SUMMARY OF THE INVENTION

The prime object of the present invention is to provide a gymnastic bicycle, which has a higher rotation speed ratio and higher exercise result. Between the driving wheel and the fly wheel of the transmission mechanism, there is a set of transmission wheels, whereby the rotation speed ratio between the driving wheel and the fly wheel reaches 1:9.

Another object of the present invention is to provide an improved transmission mechanism for the exercise bicycle, in which the loaded fly wheel and the driving wheel are mounted in parallel on the same shaft; the transmission mechanism includes also a set of transmission wheels that comprises a small and a large transmission wheel for transmitting the driving power of the driving wheel to the loaded fly wheel so as to increase the rotating speed of the loaded fly wheel.

A further object of the present invention is to provide a gymnastic bicycle with a higher rotation speed ratio by reducing the dimensions of the loaded fly wheel.

A still further object of the present invention is to provide a parallel mounting structure for the loaded fly wheel and the driving wheel; by means of the aforesaid parallel mounting structure, the dimensions of the transmission mechanism can be reduced to such an extent that the whole transmission mechanism may be mounted and sealed in a small case.

DESCRIPTION OF THE PREFERRED EMBODIMENT

Figure 1:
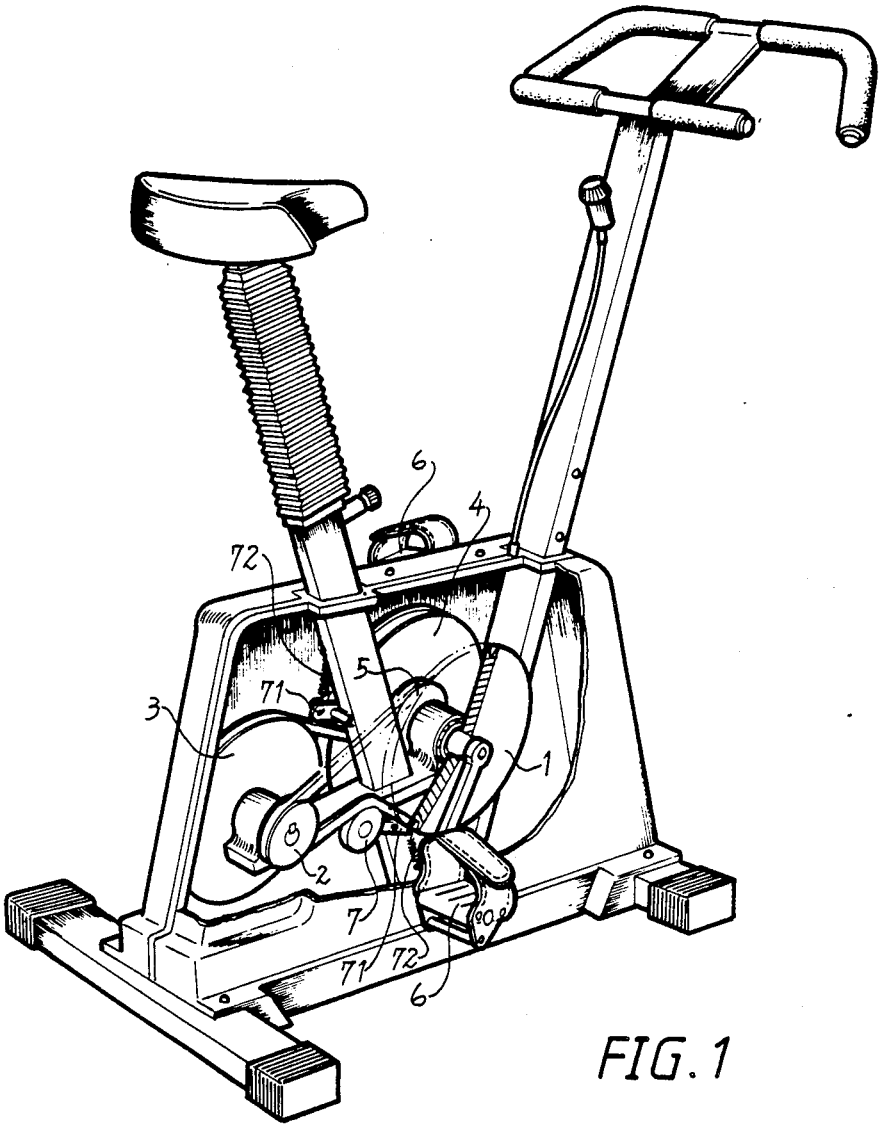
FIG. 1 is a fragmental sectional view of the gymnastic bicycle according to the present invention.
Figure 4:
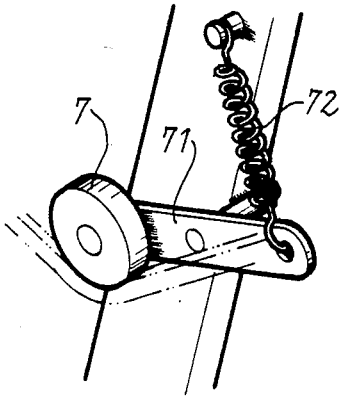
FIG. 4 is a perspective view of the tension pulley in FIG. 1.
Figure 2:
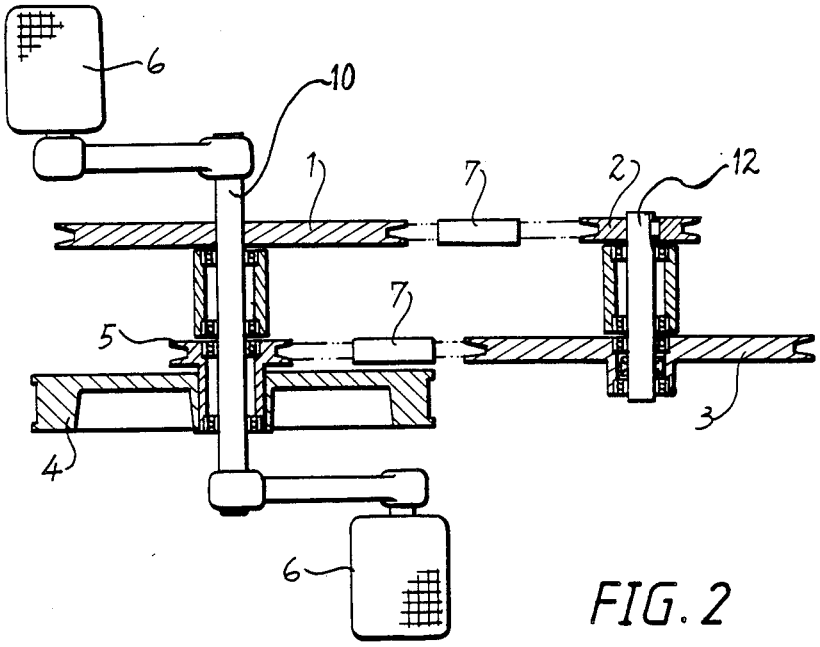
FIG. 2 is a top sectional view of the transmission mechanism of the gymnastic bicycle of the present invention.
Figure 3:
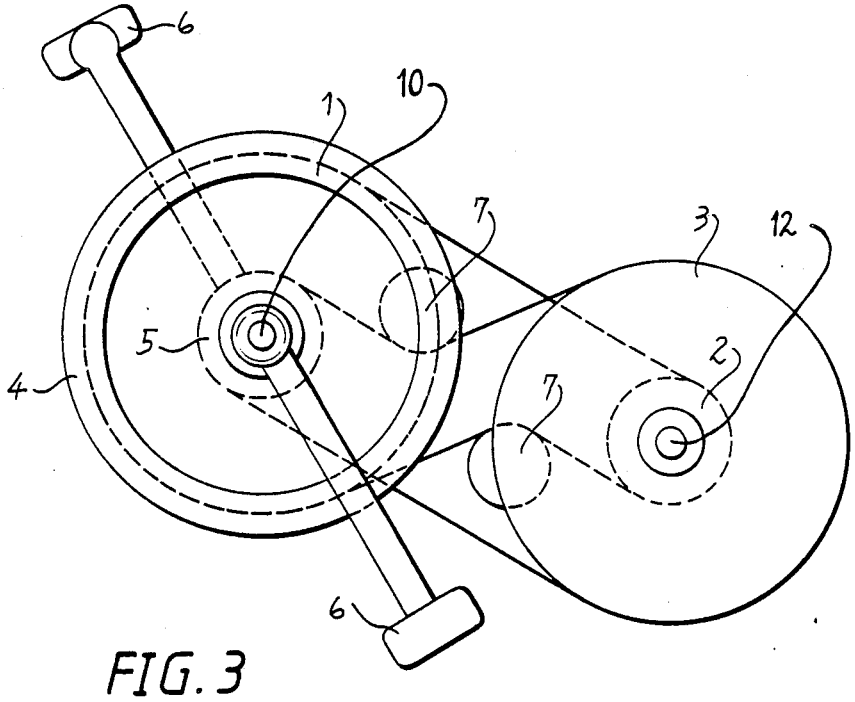
FIG. 3 is a side view of the transmission mechanism of the gymnastic bicycle according to the present invention.

The improved transmission mechanism of the gymnastic bicycle of the present invention comprises a driving wheel 1 mounted on a first shaft 10, a first transmission wheel 2 mounted on a second shaft 12, a second transmission wheel 3 on the second shaft 12 with the wheel 2, a fly wheel 4 on the first shaft 10 with driving wheel 1; a loaded fly wheel 4 is mounted on first shaft 10 by means of a third transmission wheel 5 and a bearing member. As the driving wheel 1 is fixedly attached to first shaft 10, upon turning the pedals 6, the driving wheel 1 will be driven through the first shaft 10 directly. The driving wheel 1 drives the transmission wheels 2 and 3 via a belt; then, the transmission wheel 3 drives the transmission wheel 5 via a belt so as to drive the loaded fly wheel 4.

The diameters of the driving wheel 1 and the transmission wheel 3 are the same, while the diameters of the transmission wheels 2 and 5 are the same, but their diameters are only equal to $\frac{1}{3}$ of the diameter of the driving wheel 1. As the turns of two shafts are in inverse proportion to the wheel diameters of the two shafts, the first transmission wheel will rotate three turns upon the driving wheel 1 rotating one turn; upon the second transmission wheel 3 rotating one turn, the third transmission wheel 5 will rotate three turns. In other words, upon the driving wheel 1 rotating one turn, the fly wheel 4 will rotate nine turns; i.e., a ratio of 1:9.

The loaded fly wheel of the present invention is three times higher in rotating speed than the fly wheel in conventional gymnastic bicycles because of the conventional fly wheel being driven directly by the driving wheel. This means that the loaded fly wheel of the present invention can provide the same exercise result as that of the conventional fly wheel, but has a smaller diamension so as to reduce the dimensions of the gymnastic bicycle.

Moreover, as the size of the fly wheel is about the same as that the driving wheel of the present invention; i.e., being smaller than the loaded fly wheel in the conventional gymnastic bicycle, and it is mounted in parallel with the driving wheel, the size of the whole transmission mechanism is much smaller than that of a conventional transmission mechanism. The whole transmission mechanism can be mounted and sealed in a small box as shown in FIG. 1.

The use of transmission belt in the present invention can eliminate the noise generally generated by the gears and chain; therefore, the gymnastic room or site can be maintained in a quiet atmosphere. The tension pulley 7 in the FIGS. is used for adjusting the tension of belt by means of an arm 71 and a spring 72. One end of the arm 71 is mounted with the tension pulley 7, while the other end thereof is loaded with the spring 72 so as to have the tension pulley had a constant and suitable pressure applied to the belt.

I claim:

1. An improved transmission mechanism for exercise bicycles comprising:

a first shaft having pedals attached thereto;

a second shaft spaced from said first shaft;

a driving wheel mounted on said first shaft, said driving wheel being drivable by said pedals;

a first transmission wheel mounted on said second shaft, the diameter of said first transmission wheel being equal to $\frac{1}{3}$ of that of said driving wheel, and said first transmission wheel being coupled with said driving wheel via a first belt;

a second transmission wheel mounted on said second shaft, the diameter of said second transmission wheel being equal to that of said driving wheel;

a third transmission wheel mounted on said first shaft, the diameter of said third transmission wheel being equal to $\frac{1}{3}$ of that of said driving wheel, and said third transmission wheel being coupled with said second transmission wheel via a second belt;

a loaded fly wheel mounted on said first shaft, the diameter of said fly wheel being equal to that of said driving wheel; said loaded fly wheel being driven to rotate upon said third transmission wheel being driven by said second belt; and whereby when said pedals drive said driving wheel to rotate one turn, said loaded fly wheel on the first shaft as said driving wheel will rotate nine turns.

* * * * *